US006302721B1

(12) United States Patent
Turner et al.

(10) Patent No.: US 6,302,721 B1
(45) Date of Patent: Oct. 16, 2001

(54) LATCHING ADAPTER FOR INSTALLATION ON A CABLE CONNECTOR

(75) Inventors: Craig Walton Turner; Fred David Parnell, both of Raleigh, NC (US)

(73) Assignee: International Business Machines Corporation, Armonk, NY (US)

( * ) Notice: Subject to any disclaimer, the term of this patent is extended or adjusted under 35 U.S.C. 154(b) by 0 days.

(21) Appl. No.: 09/477,165

(22) Filed: Jan. 4, 2000

(51) Int. Cl.[7] ..... H01R 13/62; H01R 13/64; H01R 13/58; H01R 13/627; H01R 13/56

(52) U.S. Cl. ..... 439/372; 439/472; 439/352; 439/445

(58) Field of Search ..... 439/372, 373, 439/470, 472, 304, 445, 369, 352

(56) References Cited

U.S. PATENT DOCUMENTS

| | | | | |
|---|---|---|---|---|
| 3,622,943 | * | 11/1971 | Reimer | 439/472 |
| 4,431,244 | | 2/1984 | Anhault et al. | 339/91 R |
| 4,664,463 | * | 5/1987 | Carmo | 439/369 |
| 4,871,325 | * | 10/1989 | Maejima et al. | 439/353 |
| 4,900,263 | * | 2/1990 | Manassero et al. | 439/358 |
| 5,151,034 | * | 9/1992 | Chandler et al. | 439/79 |
| 5,169,332 | | 12/1992 | Cooke et al. | 439/304 |
| 5,288,241 | | 2/1994 | Davidge et al. | 439/304 |
| 5,472,355 | * | 12/1995 | Wittmann | 439/373 |
| 5,507,664 | | 4/1996 | Carmo | 439/372 |
| 5,779,495 | * | 7/1998 | Dechelette et al. | 439/353 |
| 6,059,597 | * | 5/2000 | Endo et al. | 439/352 |
| 6,080,004 | * | 6/2000 | Kovacik et al. | 439/369 |
| 6,174,190 | * | 1/2001 | Tharp et al. | 439/352 |

* cited by examiner

*Primary Examiner*—Paula Bradley
*Assistant Examiner*—Edwin A. León
(74) *Attorney, Agent, or Firm*—Ronald V. Davidge; J. Bruce Schelkopf

(57) ABSTRACT

An adapter is configured to be installed on an existing cable, extending along a connector of the cable to present a latching surface on a flexible arm of the adapter for engagement with a latching surface within a latching member adjacent a port connector of a device. When these latching surfaces are engaged with one another, the cable connector is held in engagement with the port connector. The flexible arm may then be manually depressed to release the engagement of these latching surfaces. The adapter is installed on the existing cable by placing the cord of the cable between a pair of hooks extending in opposite directions from the adapter, and by then turning the adapter on the cord so that the hooks are brought into position to extend partly around the cord.

10 Claims, 2 Drawing Sheets

LATCHING ADAPTER FOR INSTALLATION ON A CABLE CONNECTOR

BACKGROUND OF THE INVENTION

1. Field of the Invention

This invention relates to providing secure mechanical connections between cable connectors and mating connectors on terminals, and, more particularly, to providing an adapter for an existing type of cable connector to provide a means to removably latch the cable connector in place on a mating connector.

2. Background Information

A number of standard types of cable connectors do not include provisions for latching or otherwise fastening the cable connectors in engagement with the mating terminal connectors into which they are engaged. When such provisions are absent, a cable connector can be inadvertently, and often easily, pulled away from the receptacle in which it is plugged, or the cable connector may be pulled outward far enough to break one or more electrical connections with this receptacle. When either of these events causes a disconnection between a terminal and a network or system, the operation of the terminal and an associated portion of the system to which it is connected is interrupted. Often this happens without the cable disconnection being noticed, so that it is difficult to determine why operations were interrupted.

Significant examples of applications in which inadvertent cable disconnection can occur arise in the retail point of sale environment, where a number of terminals are placed in check out lines, being connected to various signal cables having standard connectors, such as the USB Type B plug, which are not equipped with provisions for latching or otherwise fastening the cable connectors in place on the connectors into which they are plugged. In this environment, the consequences of an inadvertent cable disconnection can be especially serious, as interrupting the operation of a terminal causes delays in serving customers, and often results in an expensive service call.

Thus, what is needed is apparatus for latching or fastening conventional cable connectors to various types of terminals. Since various types of system connectors are in widespread use, including installation within existing cable networks, and since such system connectors are available from a number of manufacturers, such apparatus is preferably installed over or around existing connector connectors, without requiring further modification to the connectors or cables themselves.

DESCRIPTION OF THE RELATED ART

Many cable connectors include provisions for fastening or latching the connector in place on mating connector hardware. For example, most of the cable connectors used to connect peripheral terminals or communications lines to personal computers include a pair of screws or thumbscrews engaging threaded holes adjacent the connectors into which the cable connectors are installed, while the cable connectors attached to printers generally include notches into which spring clips adjacent the mating printer connectors are rotated to hold the cable connectors in place.

U.S. Pat. No. 4,431,244 describes an electrical connector assembly in which a latching lever is formed in the wall of the receptacle connector of the assembly. The lever has a latch engageable with a catch on the mating connector. The lever is pivotally mounted on the receptacle connector housing by integral live hinge pivots which extend laterally from the sides of the lever so that the lever is pivotable about an axis passing laterally through the receptacle housing, thereby providing a very low profile connector.

U.S. Pat. No. 5,507,664 describes an adapter for releasably holding a power supply cord connector in place on a panel mounted power connector. The base of the adapter is fastened over at least a part of the panel mounted connector, being attached on or below the mounting panel. The power supply cord connector is matingly coupled to the panel mounted connector in the adapter, and a fastening member, pivotally mounted on the base, is placed over the power supply cord connector to prevent separation of the connectors and to provide strain relief to the cable/connector joints of the power supply cord connector.

Other U.S. Patents describe methods to prevent the removal of a cable connector, which is otherwise attached to a terminal connector without releasing a lock with an encoded key. For example, U.S. Pat. No. 5,288,241 describes a cover which is locked in place over a cable connector engaging a terminal connector in a manner preventing access to screws holding the cable connector in place, while U.S. Pat. No. 5,169,332 describes methods for making a cable connector removable only following access within a cover of a system or terminal, with the cover being held in place by a keylock.

Still, what is needed is apparatus for latching or fastening conventional cable connectors to various types of terminals.

BRIEF SUMMARY OF THE INVENTION

In accordance with a first aspect of the present invention, there is provided apparatus for holding a cable in engagement with a port connector of a device. The cable includes a cord and a cable connector. The apparatus includes a latching member and an adapter. The latching member, which is in the device adjacent the port connector, has a first latching surface. The adapter, which extends along the cable connector, includes clamping surfaces holding the adapter in a fixed relationship with the cable connector, whether the cable connector is engaged with the port connector or disengaged therefrom. The adapter also includes a second latching surface held in engagement with the first latching surface, when the cable connector fully engages the port connector, and an externally accessible actuation surface movable to disengage the second latching surface from the first latching surface.

DETAILED DESCRIPTION OF THE INVENTION

Figure 1:
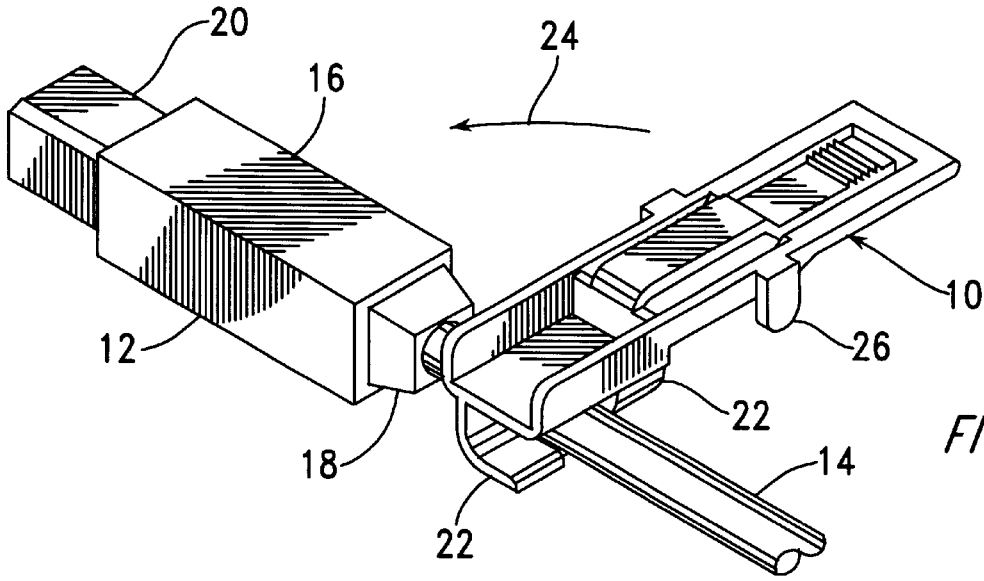
FIG. 1 is a perspective view an adapter built in accordance with the present invention in an initial stage of installation on a conventional cable connector.

FIG. 1 is a perspective view of an adapter 10, built in accordance with the present invention, in an initial stage of installation over a cable connector 12 from which a cable cord 14 extends. The connector 12 includes a body 16, a flexible strain relief portion 18 through which the cable cord 14 extends, and a shell 20, within which various terminal elements (not shown) extend to form electrical connections. The connector 12 is, for example, a conventional type of cable connector lacking a mechanism for latching, or otherwise fastening, to a mating connector on a terminal or system device. An example of such a connector is the USB Type B plug. The adapter 10 includes a pair of oppositely directed hooks 22, which, in the initial stage of installation shown in FIG. 1, extend along opposite sides of the cable cord 14.

The adapter 10 is initially installed manually in the position of FIG. 1, over the cable cord 14 and adjacent the strain relief portion 18 of the cable connector 12. Next, the adapter 10 is manually rotated in the direction of arrow 24, with the downward extending tabs 26 of the adapter 10 being brought into place on opposite sides of the connector body 16 to hold the adapter 10 in alignment with the cable connector 12. As the adapter 10 is manually rotated, both hooks 22 are brought into position under the cable cord 14 to hold the adapter 10 in place on the cable cord 14.

Figure 2:
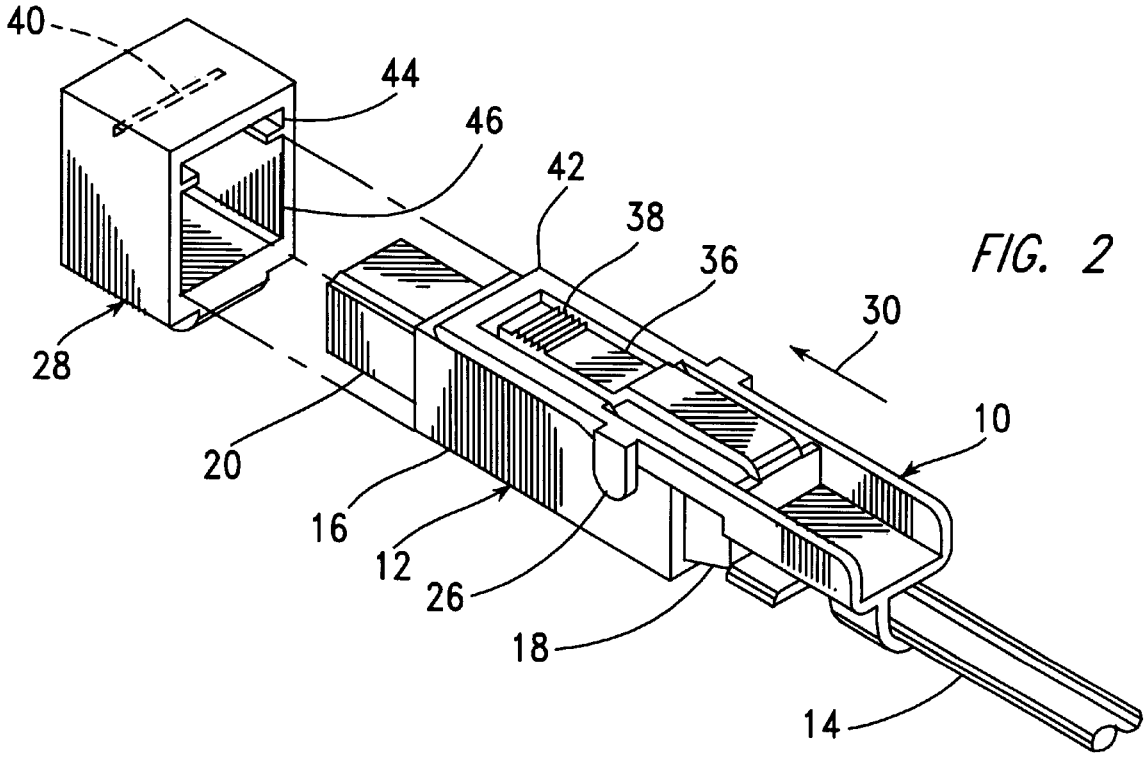
FIG. 2 is a perspective view of the adapter of FIG. 1 installed on the conventional cable connector of FIG. 1 in an exploded relationship with a latching member forming part of the terminal into which the cable connector is plugged.
Figure 3:
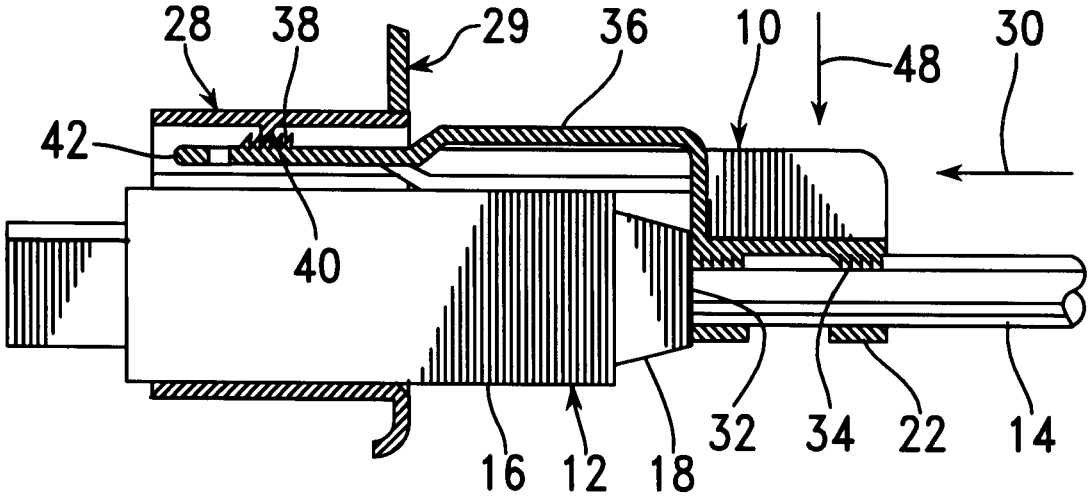
FIG. 3 is a longitudinal cross-sectional elevation of the adapter and connector of FIG. 1 installed within the latching member of FIG. 2.

FIGS. 2 and 3 are views of the adapter 10 as fully installed on the connector 12, together with a latching member 28 which forms part of a terminal device 29 into which the connector 12 is plugged. FIG. 2 is a perspective drawing showing the connector 12 and adapter 10 in an exploded relationship with the latching member 28, while FIG. 3 is a longitudinal cross-sectional elevation showing the connector 12, the adapter 10, and the latching member 28 engaged with one another. When the cable connector 12 is in the position shown by FIG. 3, contact terminals (not shown) engage mating contact terminals within a port connector (not shown) of the terminal device 29.

After the rotation of the adapter 10 on the cable cord 14 is completed, the adapter 10 is pushed in the distal direction of arrow 30 to rest against an end surface 32 of the strain relief portion 18. Angled mounting serrations 34 hold the adapter 10 in position on the cable cord 14, preventing the adapter 10 from sliding opposite the direction of arrow 30. Each group of mounting serrations 34 is directly above a corresponding hook 22, which holds the cable cord 14 against the opposing mounting serrations 34.

The adapter 10 also includes a flexible latch arm 36 extending in the distal direction of arrow 30 to present a group of angled latching serrations 38 within the latching member 28. A single downward-extending tooth 40, forming a part of the latching member 28 engages the angled latching serrations 38 to prevent subsequent motion opposite the distal direction of arrow 30. The group of angled latching serrations 38 extends far enough in the direction of arrow 30 to ensure engagement between the tooth 40 and the latching serrations 38 when the cable plug 12 is fully inserted, regardless of expected variations in the length, also in the direction of arrow 30, of the strain relief portion 18, as such variations change the location of the adapter 10 as installed on the cable plug 12.

The adapter 10 preferably includes a tab 42 which extends into an upper cavity 44 of the latching member 28 while the connector body 16 extends into a lower cavity 46 of the latching member 28. In this way, the upper cavity 44 may be sized to fit the tab 42 closely, while the lower cavity 46 is somewhat oversized to accept various different connector bodies.

Thus, engagement between the downward-extending tooth 40 and the latching serrations 38 prevents the cable connector 12 from being inadvertently unplugged. To unplug the cable connector 12 deliberately, the flexible latch arm 36 is depressed, in the direction of arrow 48, to bring the latching serrations 38 out of contact with the tooth 40, before the cable connector 12 is pulled outward, opposite the direction of arrow 30.

While the present invention has been described in its preferred version or embodiment with some degree of particularity, it is understood that this has been done only by way of example, and that numerous changes, including changes in the arrangement of parts, may be made without departing from the scope of the invention.

What is claimed is:

1. Apparatus for holding a cable, including a cord and a cable connector, in engagement with a port connector of a device, wherein said apparatus comprises:

a latching member, including a first latching surface, in said device; and an adapter extending along said cable connector, wherein said adapter includes clamping surfaces holding said adapter in a fixed relationship with said cable connector with said cable connector disengaged from said port connector and with said cable connector engaged with said port connector, wherein said clamping surfaces include a pair of spaced-apart hooks extending partly around said cord from opposite directions with said adapter held in said fixed relationship with said cable connector, wherein said adapter is brought into said fixed relationship with said cable connector by placing said adapter over said cord with said cord extending between said spaced-apart hooks and by rotating said adapter relative to said cord as said hooks are moved into engagement with said cord, wherein said adapter additionally includes a second latching surface held in engagement with said first latching surface when said cable connector fully engages said port connector, and wherein said adapter additionally includes an externally accessible actuation surface movable to disengage said second latching surface from said first latching surface.

2. The apparatus of claim 1, wherein said clamping surfaces additionally include surfaces engaging said cable connector maintain alignment between said adapter and said cable connector.

3. The apparatus of claim 1, wherein said adapter additionally includes a flexible latching arm, extending as a cantilever in a distal direction along said adapter, said second latching surface extends along said flexible latching arm adjacent a distal end thereof, and said externally accessible actuation surface extends along said flexible latching arm between said second latching surface and a proximal end of said flexible latching arm.

4. The apparatus of claim 3, wherein said second latching surface includes a plurality of serrations, and said second latching surface includes a tooth extending into engagement with a serration within said plurality thereof.

5. The apparatus of claim 4, wherein said latching member includes first guiding surfaces forming a first cavity and second guiding surfaces forming a second cavity, said cable connector extends within said first cavity in engagement with said port connector, said adapter extends within said second cavity with said cable connector in engagement with said port connector, and said tooth extends within said second cavity.

6. The apparatus of claim 4, wherein said latching member includes first guiding surfaces forming a first cavity and second guiding surfaces forming a second cavity, said cable connector extends within said first cavity in engagement with said port connector, said adapter extends within said second cavity with said cable connector in engagement with said port connector, and said second latching surface extends within said second cavity.

7. An adapter for releasably engaging a first latching surface to hold a cable, including a cord and a cable connector, in engagement with a port connector of a device including said first latching surface, wherein said adapter comprises:

clamping surfaces holding said adapter in a fixed relationship with said cable connector with said cable connector disengaged from said port connector and with said cable connector engaged with said port connector wherein said clamping surfaces include a pair of spaced-apart hooks extending partly around said cord from opposite directions with said adapter held in said fixed relationship with said cable connector, and wherein said adapter is brought into said fixed relationship with said cable connector by placing said adapter over said cord with said cord extending between said spaced-apart hooks and by rotating said adapter relative to said cord as said hooks are moved into engagement with said cord;

a second latching surface held in engagement with said first latching surface when said cable connector fully engages said port connector; and an externally accessible actuation surface movable to disengage said second latching surface from said first latching surface.

8. The adapter of claim 7, wherein said clamping surfaces additionally include surfaces engaging said cable connector maintain alignment between said adapter and said cable connector.

9. The adapter of claim 7, wherein said adapter additionally includes a flexible latching arm, extending as a cantilever in a distal direction along said adapter, said second latching surface extends along said flexible latching arm adjacent a distal end thereof, and said externally accessible actuation surface extends along said flexible latching arm between said second latching surface and a proximal end of said flexible latching arm.

10. The adapter of claim 9, wherein said second latching surface includes a plurality of serrations, and a serration within said plurality thereof engages said first latching surface.

* * * * *